US007165690B2

(12) United States Patent
Wu

(10) Patent No.: US 7,165,690 B2
(45) Date of Patent: Jan. 23, 2007

(54) POST STRUCTURE

(75) Inventor: Amy Wu, Janghua Shien (TW)

(73) Assignee: BMP Furniture Industrial Co., Ltd., Taichung (TW)

( * ) Notice: Subject to any disclaimer, the term of this patent is extended or adjusted under 35 U.S.C. 154(b) by 229 days.

(21) Appl. No.: 10/970,083

(22) Filed: Oct. 21, 2004

(65) Prior Publication Data

US 2006/0086684 A1 Apr. 27, 2006

(51) Int. Cl.
*A47B 47/00* (2006.01)

(52) U.S. Cl. ..... 211/192; 211/187

(58) Field of Classification Search ..... 211/182, 211/192, 187, 191, 204, 208, 26, 26.2, 189; 312/257.1, 265.1; 403/362, 387, 409.1; 52/731.1, 52/731.5, 736.1, 736.2, 653.1; 248/225.11, 248/297.21

See application file for complete search history.

(56) References Cited

U.S. PATENT DOCUMENTS

| | | | | |
|---|---|---|---|---|
| 3,197,822 | A * | 8/1965 | Herrschaft | 403/387 |
| 3,848,844 | A * | 11/1974 | Barrett | 248/245 |
| 4,652,170 | A * | 3/1987 | Lew | 403/381 |
| 4,712,286 | A * | 12/1987 | Wolf | 29/463 |
| 5,715,760 | A * | 2/1998 | Frascaroli et al. | 108/50.02 |
| 6,047,838 | A * | 4/2000 | Rindoks et al. | 211/187 |
| 6,397,537 | B2 * | 6/2002 | Auer et al. | 52/282.2 |
| 6,419,331 | B2 * | 7/2002 | Wei | 312/265.1 |
| 6,547,088 | B1 * | 4/2003 | Wang | 211/187 |

* cited by examiner

*Primary Examiner*—Jennifer E. Novosad
(74) *Attorney, Agent, or Firm*—Charles E. Baxley

(57) ABSTRACT

A post structure is axially formed with a plurality of elongated grooves which are not in communication with one another, and a plurality of accessories can be inserted directly into the elongated grooves in the lateral direction. And the accessories are assembled on the post by using a plurality of locking members, thereby making the assembly of the post structure easy and quick.

1 Claim, 6 Drawing Sheets

POST STRUCTURE

BACKGROUND OF THE INVENTION

1. Field of the Invention

The present invention relates to a post structure, and more particularly to a post structure for a storage rack which can be assembled easily and quickly.

2. Description of the Prior Arts

Nowadays, the market's demand for storage rack is huge due to DIY is becoming more and more popular. Post structures are indispensable components of the storage rack. And the post structures on the current market are versatile in structure.

Referring to FIG. 1, a conventional post structure comprises a post 11 and a plurality of accessories 12. The post 11 is axially provided with a plurality of elongated grooves 13, on the opposite sides of the respective elongated grooves 13 is formed a flange 131. The respective accessories 12 are formed in response to the shape to the elongated grooves 13 of the post 11 and each has two shoulder portions 121. At predetermined positions on the accessories 12 are formed a plurality of locking holes 14.

The accessories 12 are installed in the respective elongated grooves 13 of the post 11 in such a manner that the shoulder portions 121 of the accessories 12 are used to abut against the flanges 131 of the elongated grooves 13, letting the locking holes 14 face outward, and then the accessories 12 are fixed in the post 11 by inserting the locking members 15 in the locking holes 14.

However, this conventional post structure still has some problems which will be caused in real operation. The accessory can be inserted in the elongated grooves only by inserting in the axial direction of the post but cannot by inserting directly in the lateral direction of post since it is stopped by the flange of the elongated groove. Thereby causing inconvenience in assembly.

The present invention has arisen to mitigate and/or obviate the afore-described disadvantages.

SUMMARY OF THE INVENTION

The primary object of the present invention is to provide a post structure which is axially formed with a plurality of elongated grooves which are not in communication with one another, and a plurality of accessories can be inserted directly into the elongated grooves in the lateral direction. And the accessories are assembled on the post by using a plurality of locking members, thereby making the assembly of the post structure easy and quick.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
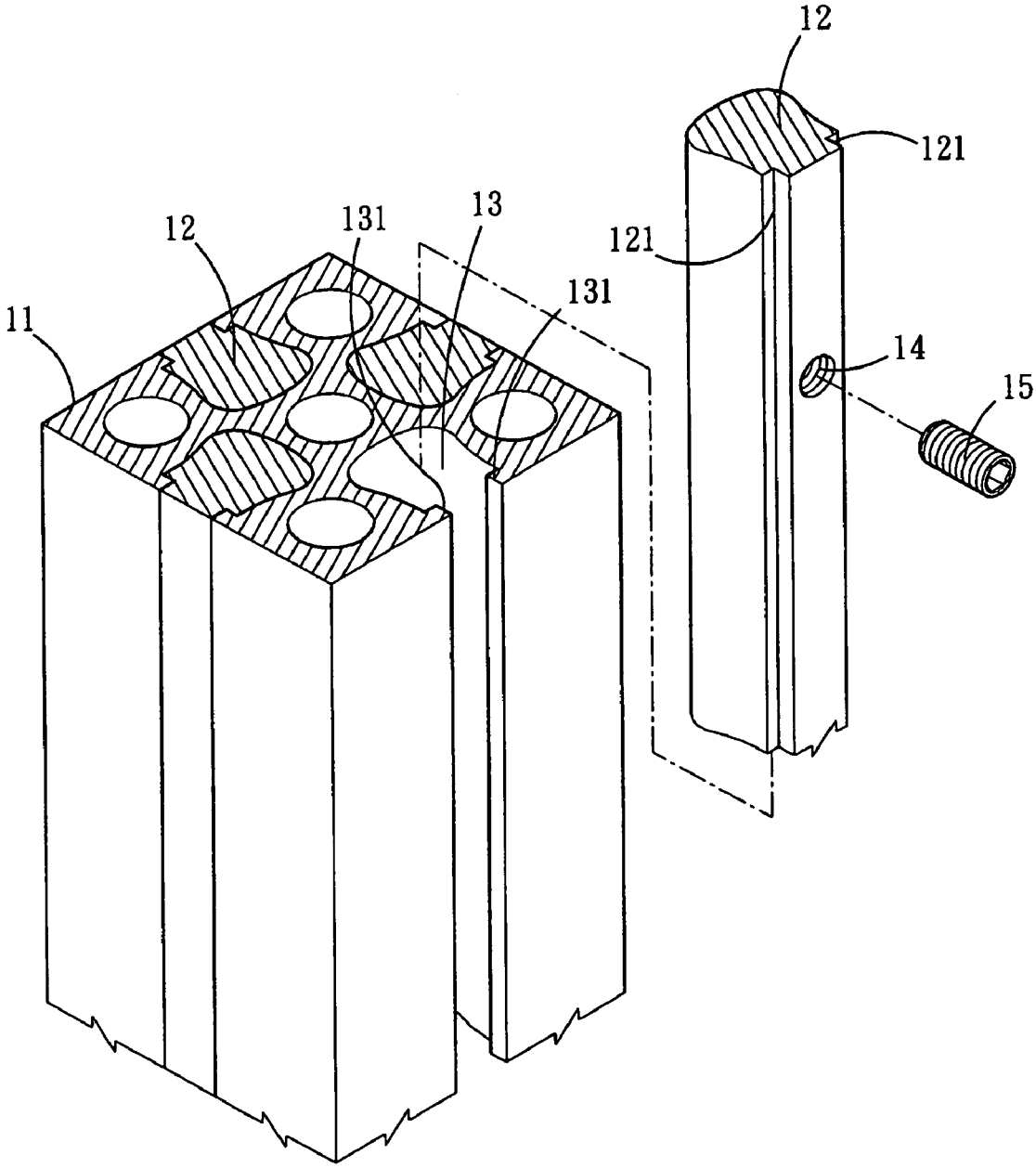
FIG. 1 PRIOR ART
FIG. 1 is an exploded view of a conventional post structure.
Figure 2:
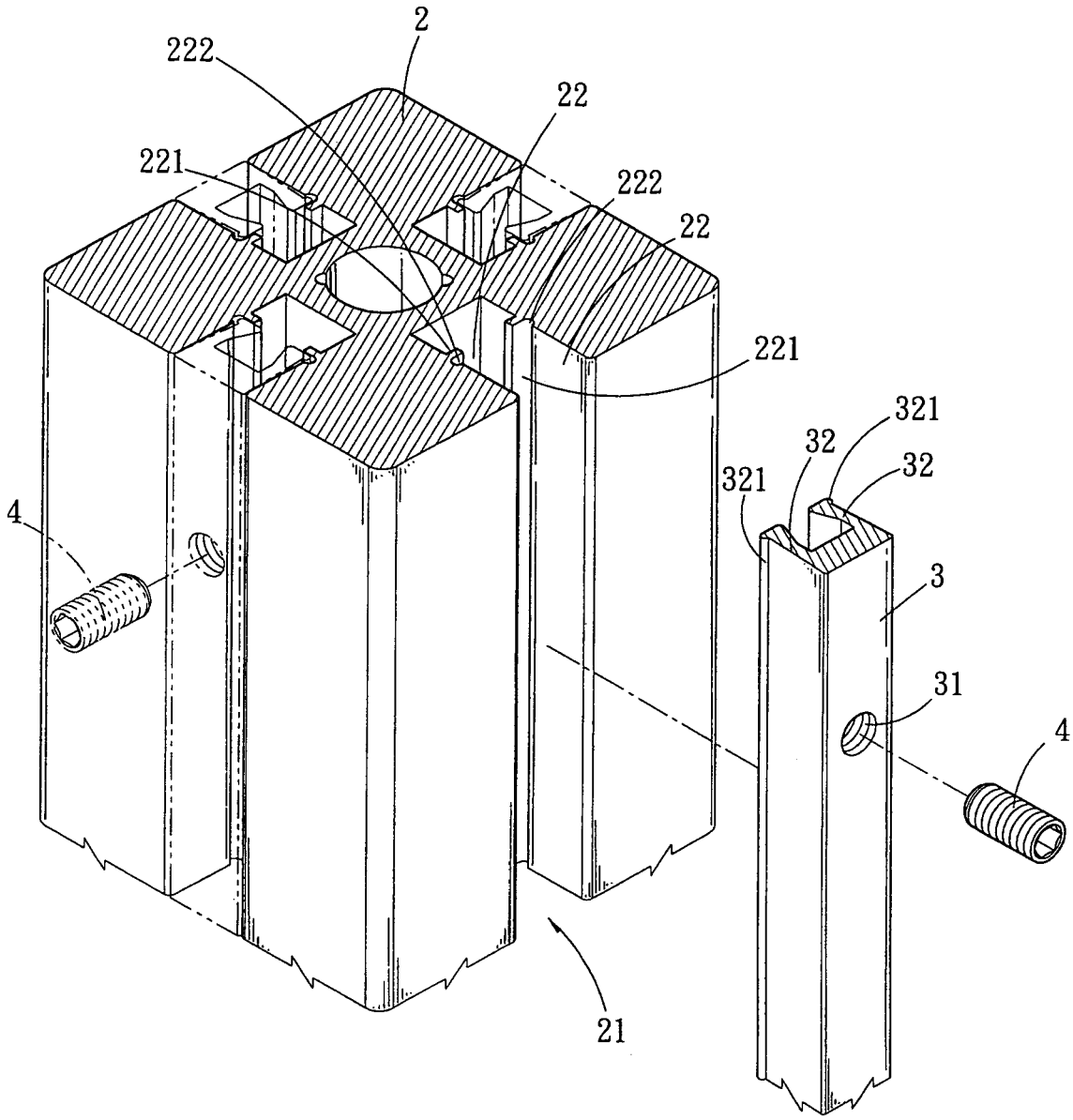
FIG. 2 is an exploded view of a post structure in accordance with the present invention.
Figure 3:
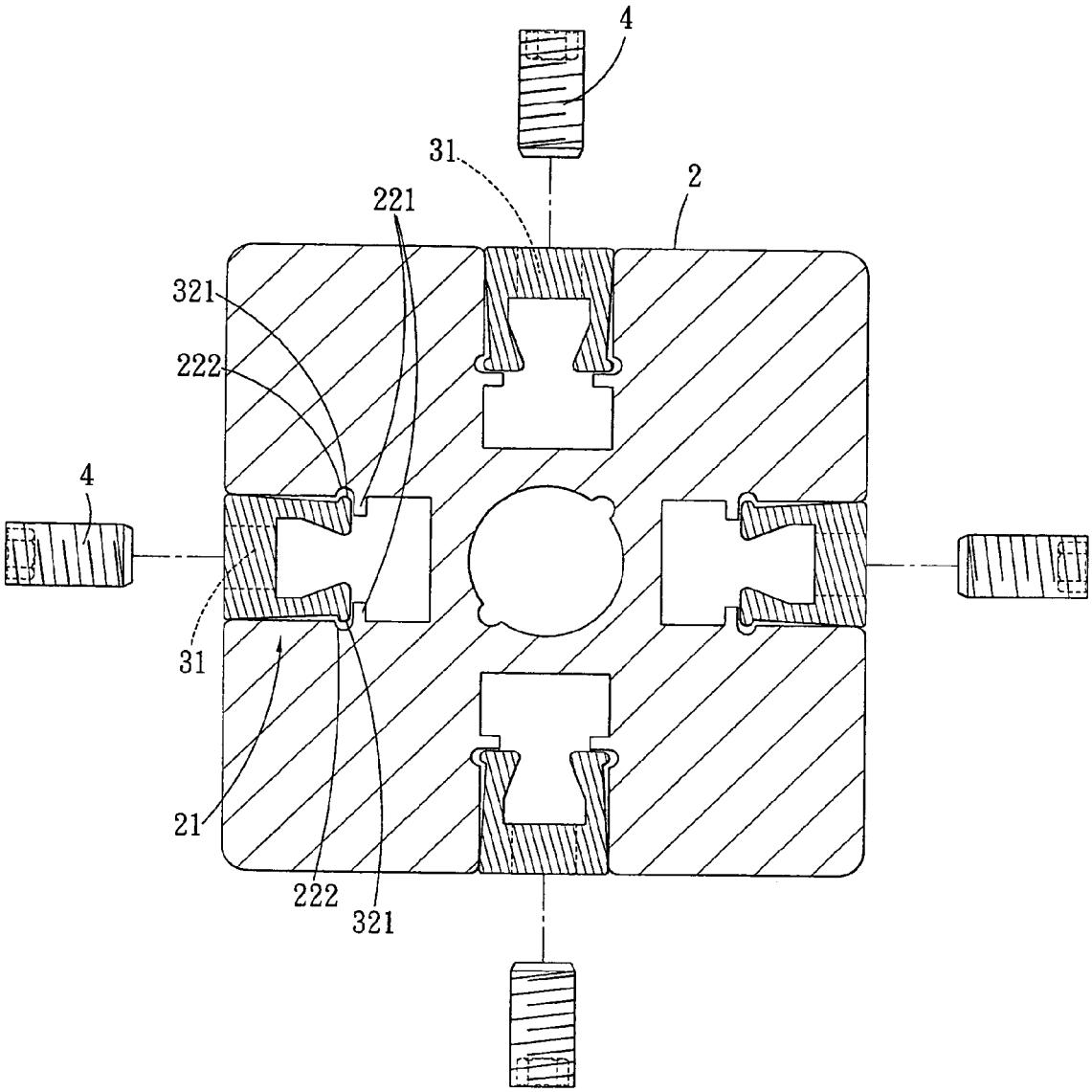
FIG. 3 is a first assembly cross sectional view of a post structure in accordance with the present invention.

Referring to FIGS. 2 and 3, a post structure in accordance with the present invention comprises: a post 2, a plurality of accessories 3 and a plurality of locking members 4.

The post 2, taking a square post 2 as an example in this embodiment, is axially formed with a plurality of elongated grooves 21 which are not in communication with one another. On two sidewalls 22 of the respective elongated grooves 21 are provided two opposite flanges 221 and locking grooves 222, and the locking grooves 222 are located between the flanges 221 and the outer edge of the elongated grooves 21.

There are four accessories 3, for example, in this embodiment. Each of the accessories 3 is made of elastic material and is formed with a plurality of through locking holes 31. On two opposite sides of the accessories 3 are provided two sidewalls 32, and at the free end of the two sidewalls 32 is formed an outward projected locking edge 321. The respective accessories 3 are inserted into the elongated grooves 21 in the lateral direction, and are stopped by the two flanges 221 inside the elongated grooves 21. The locking edges 321 of the respective accessories 3 are inserted in the locking grooves 222 on the two sidewalls 22 of the elongated grooves 21.

Figure 4:
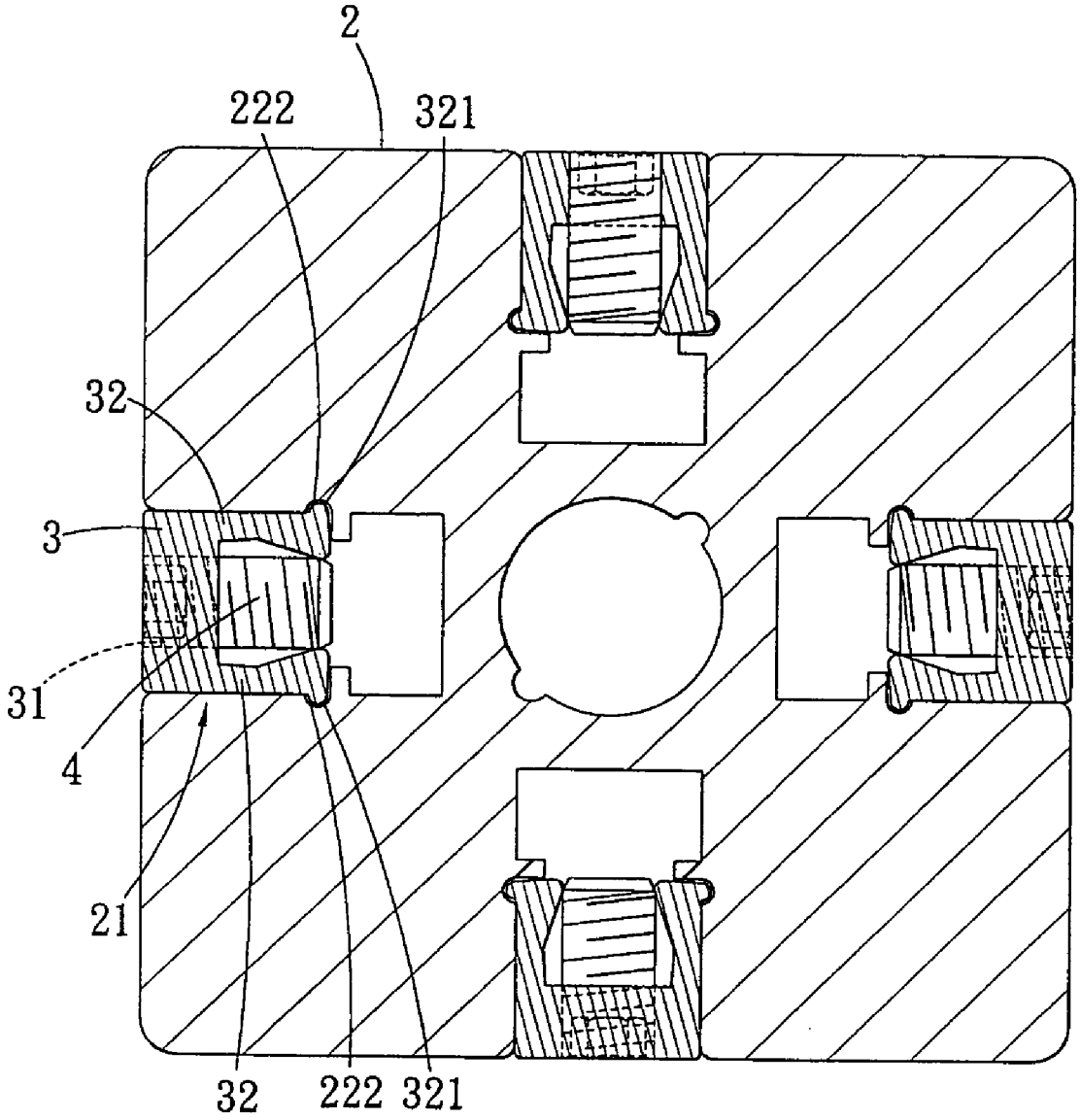
FIG. 4 is a second assembly cross sectional view of a post structure in accordance with the present invention.

Referring to FIG. 4, the locking members 4 are locked in the locking holes 31 of the respective accessories 31 so as to push the two sidewalls 32 of the accessories 3 outward a certain distance, so that the two locking edges 321 are caused to engage the two locking grooves 222 on the sidewalls of the elongated grooves 21.

Figure 5:
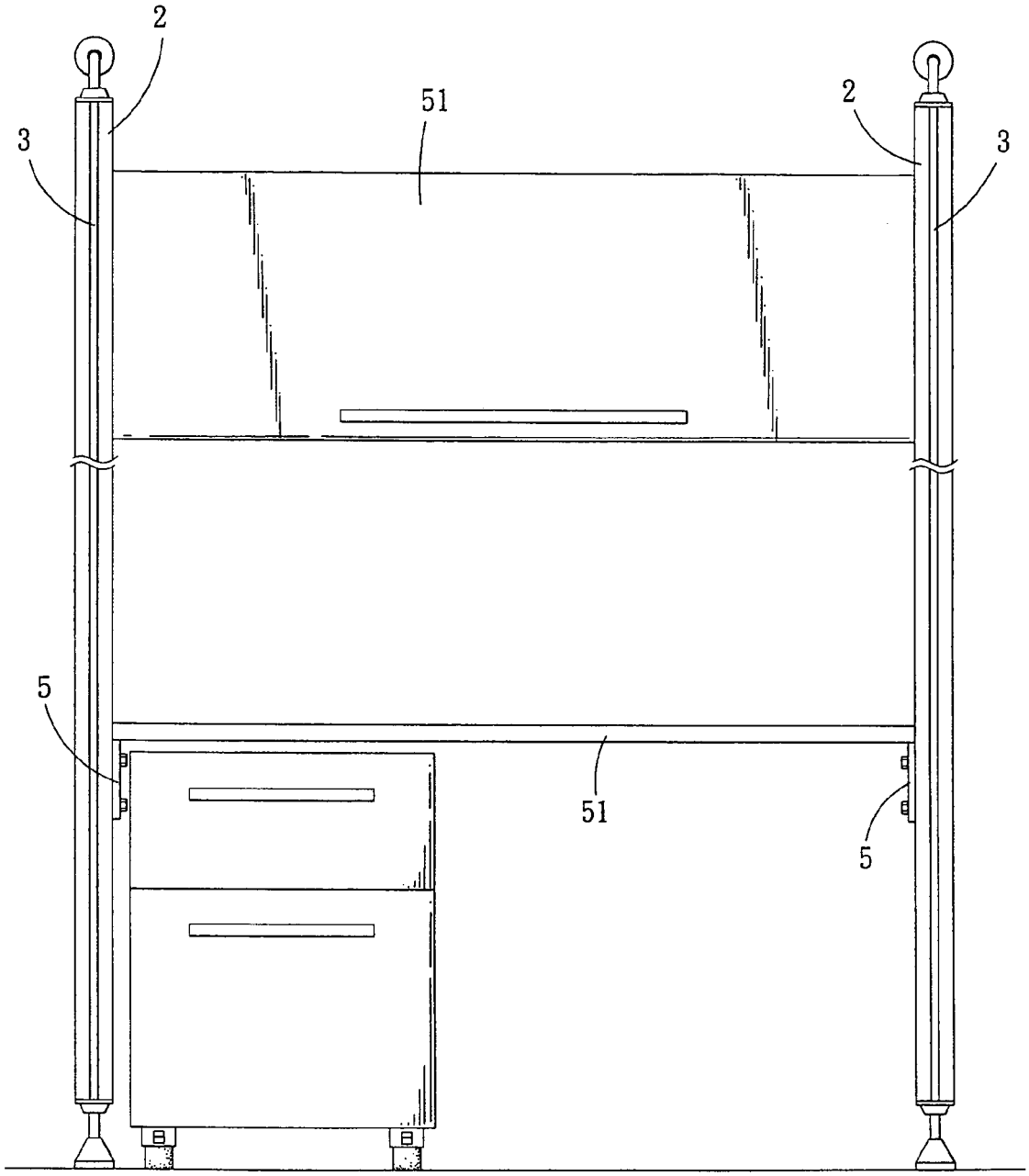
FIG. 5 is an operational view of a post structure in accordance with the present invention.

Referring to FIG. 5, after being assembled together, the respective posts 2 and the accessories 3 can be installed with a plurality of supporting members 5, so that a plurality of shelves 51 can be put on the supporting members 5 to form a rack for holding or storing objects. Since the accessories 3 can be inserted directly in the elongated grooves of the post 2 in the lateral direction, this makes the assembly easy and quick.

Figure 6:
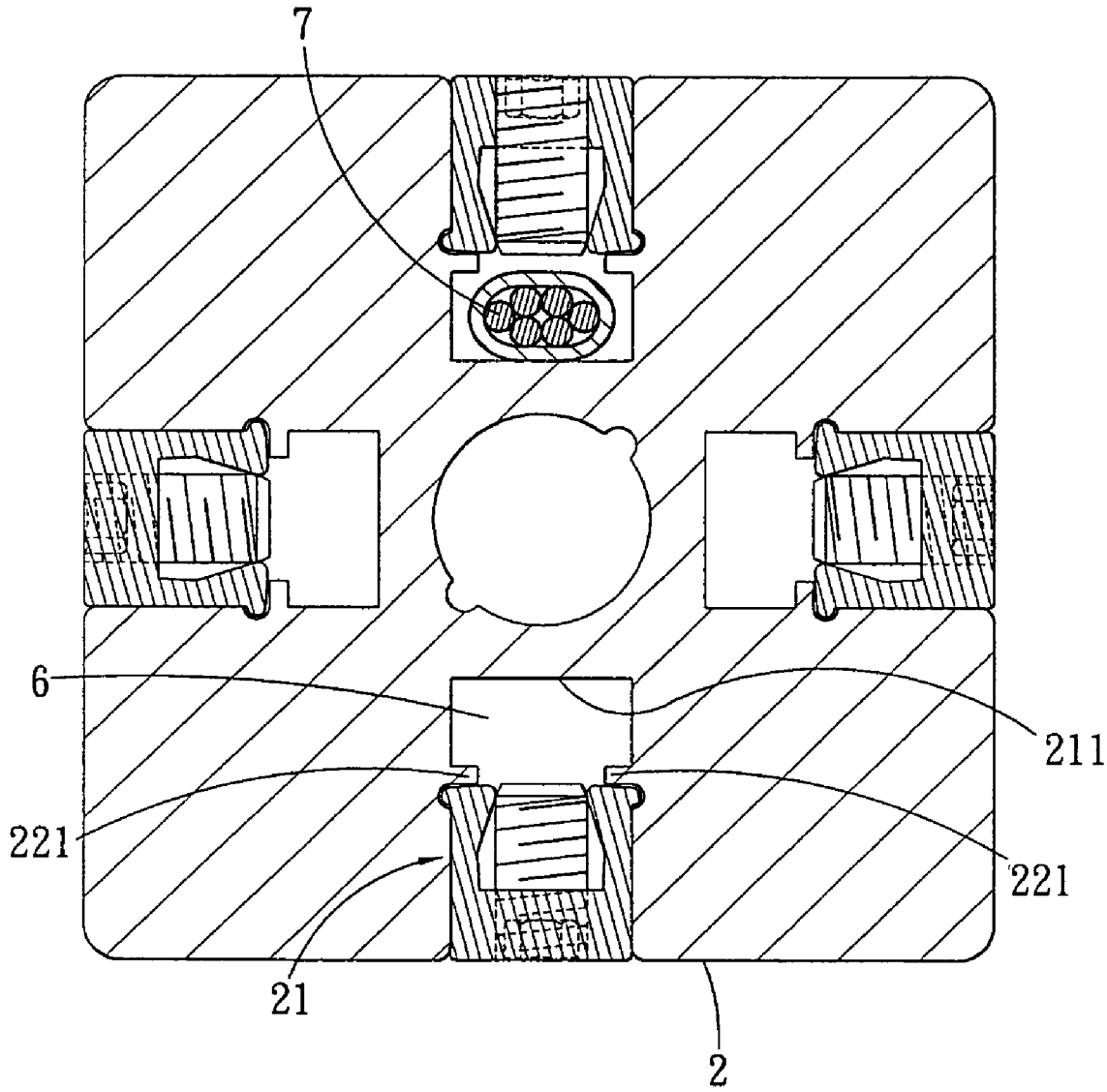
FIG. 6 is an assembly cross sectional view of a post structure which is interiorly installed with power lines, in accordance with the present invention.

Referring to FIG. 6, after the post structure is assembled, the two flanges 221 inside the elongated grooves 21 of the post 2 and the bottom surface of the elongated grooves 21 will define a space 6 therebetween. To improve the functionality, the rack (not shown) is preferable provided with power sockets. The space 6 can be provided for accommodation of power lines 7, so that the power lines 7 is hidden in the rack, thereby making the rack look neat and tidy. Furthermore, on the outer surface of the posts can be adhered with decoration papers for decorating the post.

While we have shown and described various embodiments in accordance with the present invention, it should be clear to those skilled in the art that further embodiments may be made without departing from the scope of the present invention.

What is claimed is:

1. A post structure comprising:

a post axially formed with a plurality of elongated grooves, on two sidewalls of the respective elongated grooves being provided two opposite inwardly extending flanges and locking grooves, and the locking grooves located between the flanges and outer edges of the elongated grooves;

a plurality of accessories each formed with a plurality of through locking holes and two sidewalls, at a free end of the two sidewalls is formed an outward projected locking edge, respectively; the respective accessories being inserted into the elongated grooves directly in a lateral direction and being stopped by the two flanges inside the elongated grooves, the locking edges of the respective accessories inserted in the locking grooves on the two sidewalls of the elongated grooves;

a plurality of locking members locked in the locking holes of the respective accessories so as to push the two sidewalls of the accessories outward a certain distance, so that the two locking edges are caused to engage the two locking grooves on the sidewalls of the elongated grooves.

* * * * *